US008968533B2

(12) United States Patent
Harris et al.

(10) Patent No.: US 8,968,533 B2
(45) Date of Patent: Mar. 3, 2015

(54) ELECTROPLATING PROCESSOR WITH GEOMETRIC ELECTROLYTE FLOW PATH

(75) Inventors: Randy A. Harris, Kalispell, MT (US); Daniel J. Woodruff, Kalispell, MT (US); Jeffrey I. Turner, Kalispell, MT (US); Gregory J. Wilson, Kalispell, MT (US); Paul R. McHugh, Kalispell, MT (US)

(73) Assignee: APPLIED Materials, Inc, Santa Clara, CA (US)

( * ) Notice: Subject to any disclaimer, the term of this patent is extended or adjusted under 35 U.S.C. 154(b) by 274 days.

(21) Appl. No.: 13/468,273

(22) Filed: May 10, 2012

(65) Prior Publication Data

US 2013/0299343 A1 Nov. 14, 2013

(51) Int. Cl.

| | |
|---|---|
| ***C25D 17/12*** | (2006.01) |
| ***C25D 17/00*** | (2006.01) |
| *C25D 7/12* | (2006.01) |

(52) U.S. Cl.

CPC ..... *C25D 17/12* (2013.01); *C25D 7/123* (2013.01); *C25D 17/001* (2013.01)

USPC ..... 204/263; 205/157

(58) Field of Classification Search

CPC ..... C25D 7/12; C25D 7/123; C25D 17/001; C25D 17/002; C25D 17/10; C25D 17/12; C25D 17/14

USPC ..... 204/263; 205/157

See application file for complete search history.

(56) References Cited

U.S. PATENT DOCUMENTS

| | | | | |
|---|---|---|---|---|
| 5,954,911 | A | 9/1999 | Bergman | |
| 6,254,742 | B1 | 7/2001 | Hanson et al. | |
| 6,383,352 | B1 | 5/2002 | Shyu | |
| 6,497,801 | B1 * | 12/2002 | Woodruff et al. | 204/230.2 |
| 6,855,235 | B2 | 2/2005 | Herchen et al. | |
| 6,881,309 | B2 | 4/2005 | Hanson | |
| 6,916,412 | B2 | 7/2005 | Woodruff | |
| D648,289 | S | 11/2011 | Mayer et al. | |
| 2001/0017258 | A1 | 8/2001 | Ishida et al. | |
| 2002/0106551 | A1 | 8/2002 | Speranza et al. | |

(Continued)

FOREIGN PATENT DOCUMENTS

| | | | | |
|---|---|---|---|---|
| JP | 2004119609 A | * | 4/2004 | H01L 21/304 |
| KR | 10-2005-0069242 A | | 7/2005 | |

OTHER PUBLICATIONS

International Searching Authority, International Search Report and Written Opinion mailed Aug. 27, 2013, in International Application No. PCT/US2013/037844.

*Primary Examiner* — Harry D Wilkins, III
*Assistant Examiner* — Ciel Thomas
(74) *Attorney, Agent, or Firm* — Kenneth H. Ohriner; Perkins Coie LLP

(57) ABSTRACT

An electroplating processor includes an electrode plate having a continuous flow path formed in a channel. The flow path may optionally be a coiled flow path. One or more electrodes are positioned in the channel. A membrane plate is attached to the electrode plate with a membrane in between them. Electrolyte moves through the flow path at a high velocity, preventing bubbles from sticking to the bottom surface of membrane. Any bubbles in the flow path are entrained in the fast moving electrolyte and carried away from the membrane. The electroplating processor may alternatively have a wire electrode extending through a tubular membrane formed into a coil or other shape, optionally including shapes having straight segments.

15 Claims, 5 Drawing Sheets

(56) References Cited

U.S. PATENT DOCUMENTS

| | | | | |
|---|---|---|---|---|
| 2004/0124090 | A1 | 7/2004 | Du et al. | |
| 2006/0137974 | A1 | 6/2006 | Du et al. | |
| 2006/0243598 | A1 | 11/2006 | Singh et al. | |
| 2007/0261964 | A1* | 11/2007 | Wilson et al. | 205/148 |
| 2010/0147679 | A1 | 6/2010 | Feng et al. | |

* cited by examiner

ELECTROPLATING PROCESSOR WITH GEOMETRIC ELECTROLYTE FLOW PATH

The field of the invention is chambers, systems, and methods for electrochemically processing semiconductor material wafers and similar substrates having micro-scale devices integrated in and/or on the work piece.

BACKGROUND OF THE INVENTION

Microelectronic devices are generally fabricated on and/or in wafers or similar substrates. In a typical fabrication process, an electroplating processor applies one or more layers of conductive materials, typically a metals, onto the substrate. The substrate is then typically subject to etching and/or polishing procedures (e.g., planarization) to remove a portion of the deposited conductive layers, to form contacts and/or conductive lines. Plating in packaging applications may be performed through a photoresist or similar type of mask. After plating, the mask may be removed, with the metal then reflowed to produce humps, redistribution layers, studs, or other interconnect features.

Many electroplating processors have a membrane separating anolyte plating liquid from a catholyte plating liquid within a bowl or vessel. In these processors, bubbles in the plating liquid may collect and stick to the bottom surface membrane. The bubbles act as an insulator, disrupting the electric field in the processor, and leading to inconsistent plating results on the work piece. Accordingly, engineering challenges remain in designing electroplating processors providing consistent plating results.

SUMMARY OF THE INVENTION

A new electroplating processor has now been invented that largely overcomes bubble-related variations in electroplating. This new electroplating processor includes an electrode tray or plate having a continuous flow path formed in a channel. The flow path may optionally be coiled. One or more electrodes are positioned in the channel, or multiple separate flow channels may be provided with a separate electrode in each channel. A membrane plate is attached to the electrode plate with a membrane in between them. Electrolyte moves through the flow path at a high velocity, preventing bubbles from sticking to the bottom surface of membrane. Any bubbles in the flow path are entrained in the fast moving electrolyte and carried away from the membrane. In an alternative design, a metal electrode, such as a platinum wire, may be positioned inside of a tubular membrane, with electrolyte flowing through the tubular membrane. The flow channels may be curved, or provided with straight segments.

BRIEF DESCRIPTION OF THE DRAWINGS

In the drawings, the same element number indicates the same element in each of the views.

DETAILED DESCRIPTION

Figure 1:
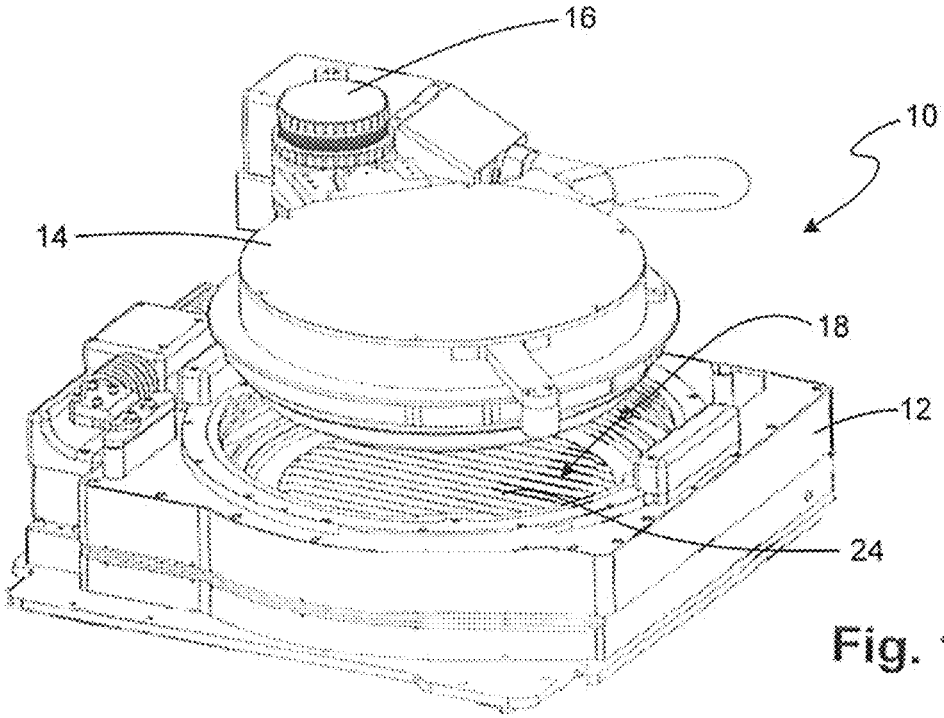
FIG. 1 is a perspective view of a new electroplating processor.
Figure 2:
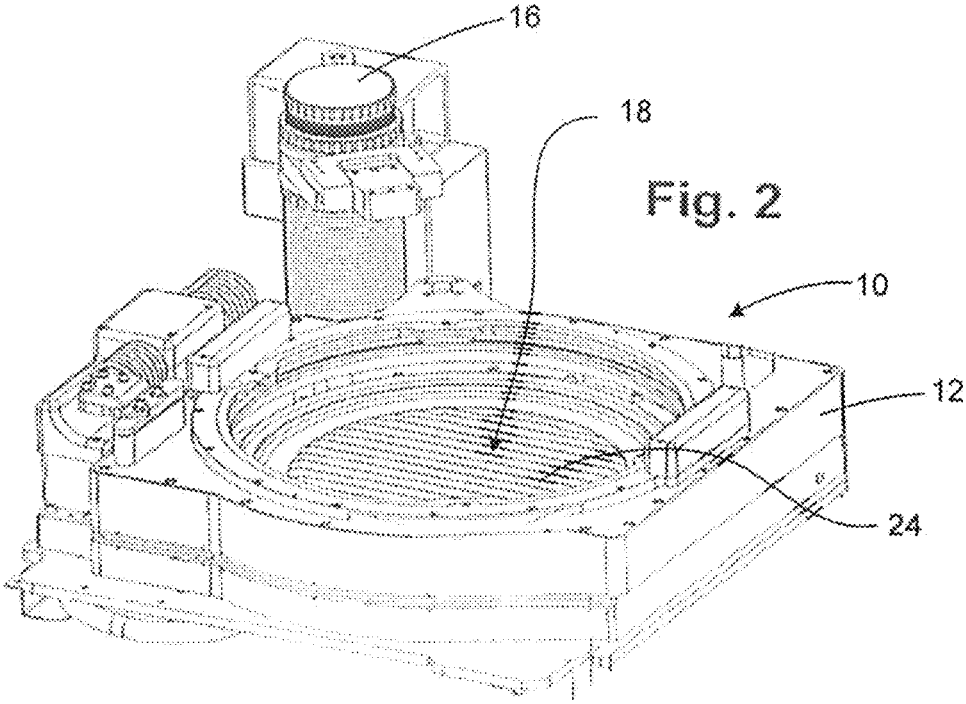
FIG. 2 is a perspective view of the processor of FIG. 1 with the head removed, for purpose of illustration.

Turning now to the drawings, as shown in FIGS. 1 and 2, an electroplating processor includes a head 14 and a base 12. A head lifter 16 lifts and lowers the head to move a work piece held in the head into a vessel or bowl 18 in the base. The vessel holds electroplating liquid. An agitator plate 24 may optionally be provided near the top of the vessel 18 to agitate the electroplating liquid adjacent to the work piece.

Figure 3:
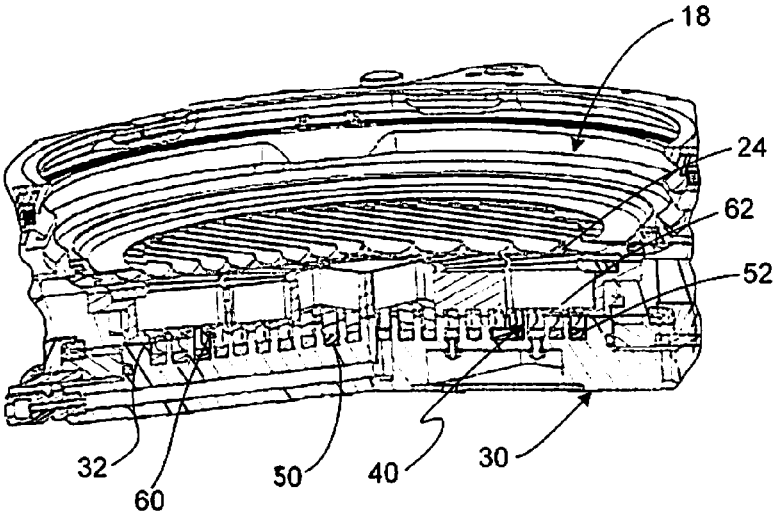
FIG. 3 is a section view through the vessel of the processor shown in FIGS. 1 and 2.
Figure 4:
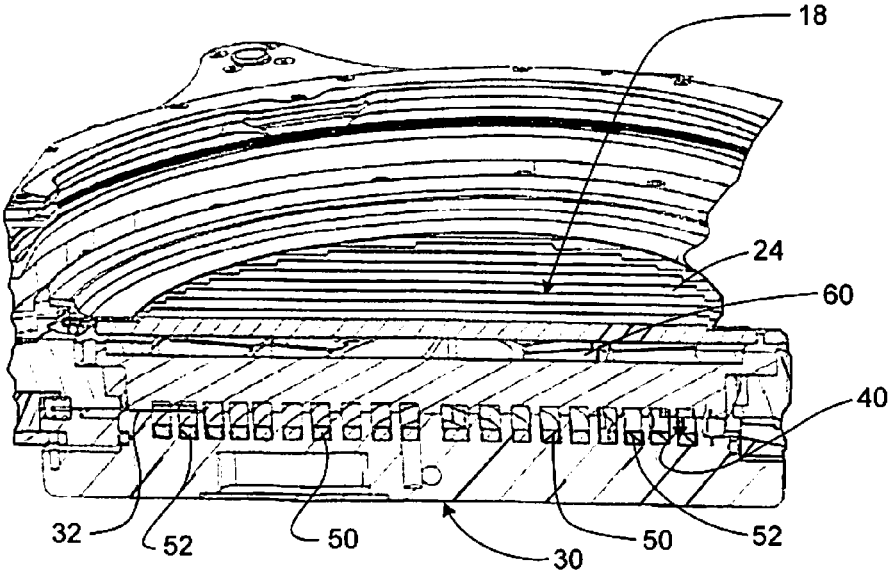
FIG. 4 is another section view through the vessel of the processor shown in FIGS. 1 and 2.
Figure 5:
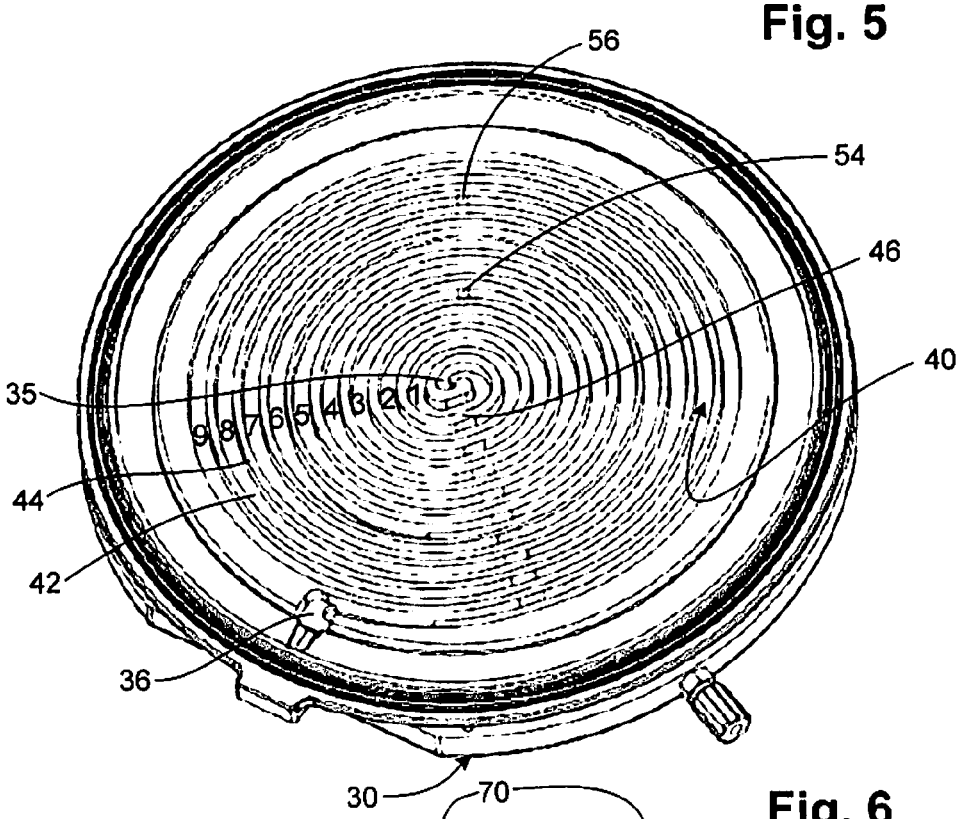
FIG. 5 is a top perspective view of the channel plate shown in FIGS. 3 and 4.

Referring now also to FIGS. 3 and 4, the vessel 18 may be divided via a membrane 32 into upper and lower chambers. A channel plate 30 is provided at the bottom of the vessel 18. The channel plate is typically an insulator, such as plastic. A channel 42 may be provided in the channel plate 30, with an anode material 52 in the channel 42. Alternatively, the channel plate 30 may be metal, such as platinum plated titanium, with a flow channel machined into the metal plate. The membrane 32 is clamped between the channel plate 30 on the bottom and a membrane plate 60 on top. As shown in FIGS. 4 and 5, a circular or coiled flow path 40 is formed in the top surface of the channel plate 30. Specifically, the coiled flow path 40 is formed via a coiled channel, groove or slot 42 in the channel plate, and by a corresponding coiled wall 44 which separates adjacent rings of the flow path 40.

The flow path 40 may be continuous and extend uninterrupted from an inlet 36 adjacent to an outer edge of the channel plate 30, to a drain 35 at or near the center of the channel plate, as shown in FIG. 5. Generally, the clamping force on the membrane 32 is highest adjacent to outside of the channel plate 30, closer to the fasteners or bolts clamping the channel plate and the membrane plate 60 against the membrane 32. Since the fluid pressure in the flow path 40 is highest at the inlet, in some designs locating the inlet towards the outside of the channel plate 30, closer to the fasteners, may provide a better seal against the membrane. In other designs, the inlet and outlet positions may optionally be switched, with the inlet adjacent to an outer edge of the channel plate 30. An alternative to the face-to-face seal shown in FIG. 4 is to install a long circular elastomer that seals the membrane to the anode surface.

The membrane plate 60 is designed as a relatively stiff structure so that it is not deflected or deformed by the fluid pressure under the membrane that is required to pump the anolyte through the spiral flow path. Upward deflection of the membrane plate 60 would create leak paths over the spiral walls and underneath the membrane that would short circuit the spiral flow path. While some fluid leakage over the wall is tolerable (i.e. a perfect seal is not required), excessive flow over the walls decreases the flow velocity in the spiral path and reduces the ability to entrain and carry away bubbles.

In the design shown in FIG. 5, the channel 42 has a rectangular cross section, with the height of the channel greater than the width of the channel. For example, the height of the channel may be twice the width of the channel 42. Other channel shapes, such as square and curved cross section channels may also be used. The cross section of the channel 42 may also vary between the inlet and outlet. The wall thickness of the channel wall 44 may also vary between the rings.

Referring still to FIG. 5, the coiled flow path 40 may be a true spiral in a mathematical sense, or other variations of a spiral. In FIG. 5, the rings of the flow path are circular, with a straight segment 46 providing the offset to have each ring of the flow path transition into adjacent rings. Similarly, the flow path may also have other shapes such as oval, elliptical, etc. The flow path 40 may also simply formed via concentric circles, or more properly circular or curved annular channels, connected by segments of any shape. Accordingly, the terms coil or coiled are used here to collectively include spirals and any other pathways having progressively expanding rings, regardless of their shape.

In FIG. 5, the rings are labeled 1-9. For a processor designed to electroplate a 300 mm diameter work piece, the flow path may have 5-15 or 7-12 rings. Processors designed to electroplate a 450 mm diameter work piece may have proportionally more rings, i.e., 7-22 rings or 10-18 rings. The flow path 40 shown in FIG. 5 having 9 rings may have a total length of about 3-6 or 4-5 meters. In selecting the number or rings and the total length of the flow path 40, as well as the cross section(s) of the channel 42, the pressure required to move anolyte through the flow path may be a limiting factor.

The channel wall 44 in the example shown has a generally flat top. A corresponding coiled plate support 62 on the bottom surface of the membrane plate 60, shown in FIG. 6, may match the shape and position of the channel wall 44. When the membrane plate 60 is clamped to the channel plate 30, with the membrane 32 between them, the top surface of the channel wall 44 aligns with bottom surface of the coiled plate support, with the membrane clamped between them. The coiled plate support 62 may be a mirror image of the channel wall 44, although they do not necessarily have the same height.

As shown in FIGS. 3 and 4, an inner or first anode 50 is positioned on the floor of the channel 42 in the inner rings of the flow path 40. A second or outer anode 52 is positioned on the floor of the channel 42 in the outer rings of the flow path 42. As shown in FIG. 5, a first electrical contact 54 connects to the first anode 50 and a second electrical contact 56 separately connects to the second anode 52. The first and second anodes do not connect to each other. However, they are electrically connected through the electrolyte, so that they are not fully electrically isolated from each other. A small gap may be provided between them. On the other hand, both the first and second anodes are in the single continuous flow path 40. While two anodes are shown, in some designs a single anode may be used, or three or more anodes may be used.

The electrical contact for each anode may be approximately centered on its length to help insure uniform electric current along the anode. For a long, thin anode spiral connected at one end, the current density along the anode may drop moving away from the contact because of the electrical resistance of the anode, itself. For very thin and/or very long electrodes, multiple connections can be made to each anode to help distribute the current uniformly.

The anodes 50 and 52 may be provided as flat strips of metal. In an inert anode design, where the anodes are not consumed during electroplating, the anodes may be platinum plated titanium. Alternatively, in an active anode design, where the anode is consumed, the anodes may be copper, or other metals.

Figure 6:
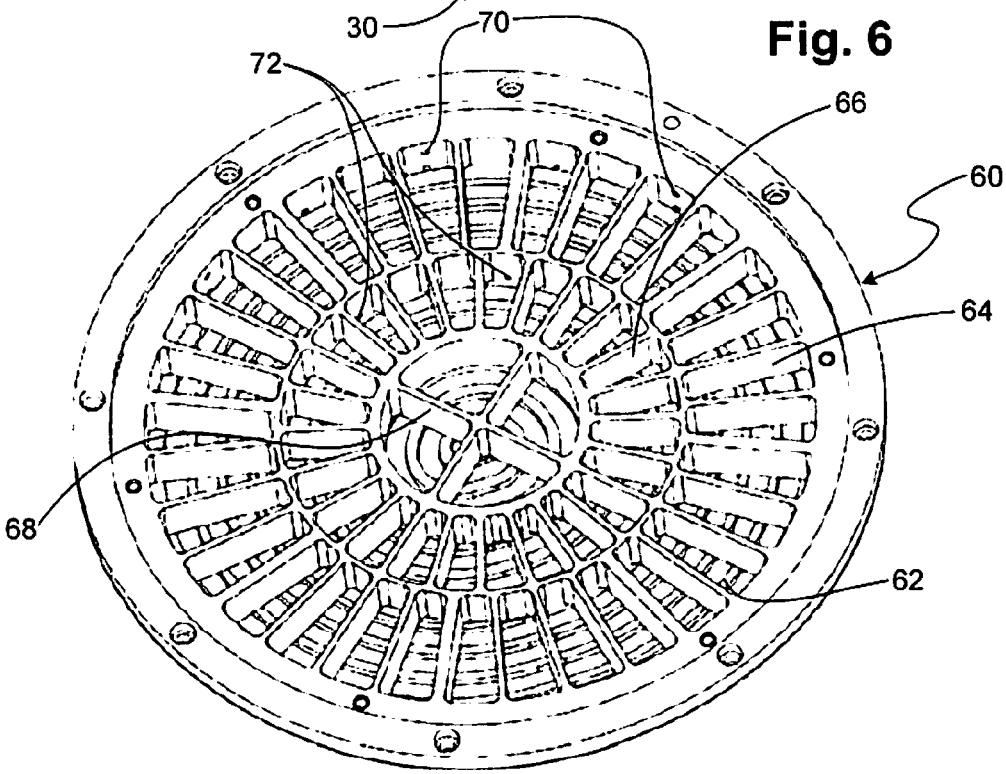
FIG. 6 is a top perspective view of the membrane plate shown in FIGS. 3 and 4.

Referring to FIG. 6, the membrane plate 60 may have an outer ring of ribs 64, and inner ring of ribs 66, and a center ring 68. The coiled membrane support 62 on the bottom surface of the membrane plate 60 may be attached to ribs. Alternatively, the coiled membrane support 62 may be integrally formed as part of the membrane plate, along with ribs and other features of the membrane plate 60. The rings of ribs provide a membrane plate 60 having a largely open cross section, to minimize affecting the electric field in the vessel, while also providing a rigid structure to clamp and seal against the membrane. The membrane plate and the channel plate are generally a di-electric material, such as polypropylene or other plastic. The membrane plate 60 may have catholyte inlets 70 and 72 in inner and outer annular sidewalls, to introduce catholyte into the vessel at a position immediately above the membrane 32.

The rings of ribs 66 can have special provision for helping to minimize disturbances to the electric field that may be detrimental to plating uniformity. For example the vertical height of the center post and inner-most ribs maybe reduced to create a larger gap between the structure and the workpiece. The center region can be particularly influenced by the structure because wafer spinning does not help average out disturbances in this region. In another example, the circular ribs may be made as thin as possible, or made thinner at the top of the structure to help minimize their disturbance of the electric field, since their influence on the wafer also cannot be averaged out by wafer rotation.

In conventional electroplating membrane processors, the anolyte, or other electrolyte, moves slowly along the membrane. This allows gas bubbles to stick to the membrane and degrading plating performance, especially with substantially horizontally oriented membranes. Using an inert anode tends to generate substantial amounts of gas bubbles, as a electrolysis reaction occurs at the surface of the inert anode releasing oxygen gas.

Gas evolution from the anode can be especially problematic for processes that have a high plating rate (and therefore a high anode current and large gas creation) necessary so that the process can finish quickly and throughout can be maximized."

In the processor 10 having a circular flow path 40 anolyte is pumped to the inlet at sufficient pressure so that it moves through the flow path at a high velocity. The velocity of the anolyte flowing through the channel is sufficient to prevent bubbles from sticking to the bottom surface of membrane 32. Rather, the bubbles are entrained in the fast moving liquid and cannot stick or collect on the membrane. Therefore, bubbles created by the process are quickly carried out of the chamber preventing them from partially or completely blocking the electrical flow path between the anode and the cathode, helping to provide a reliable process.

Figure 7:
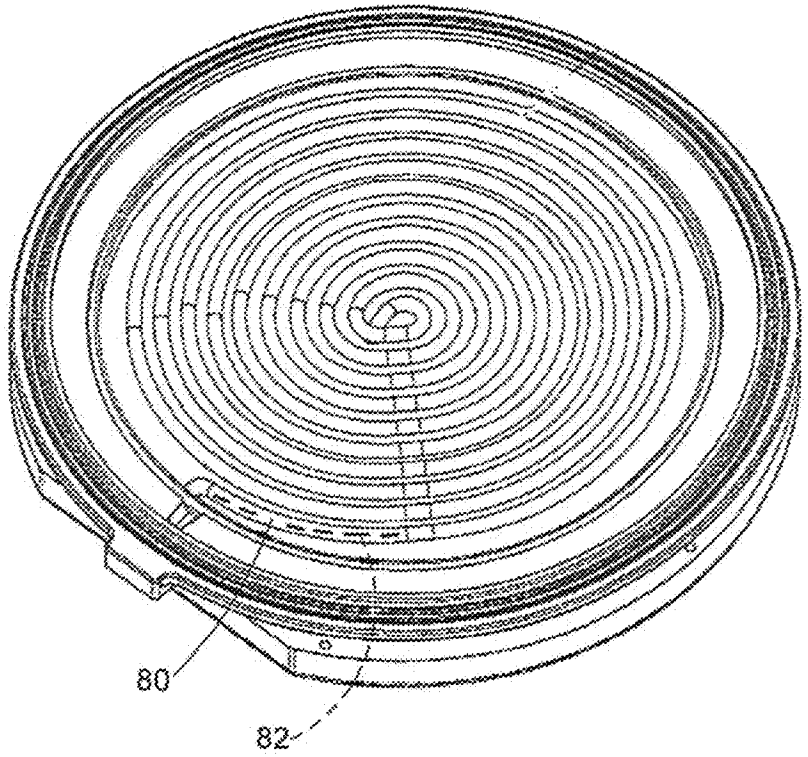
FIG. 7 is a top perspective view of an alternative design using a membrane tube.

As shown in FIG. 7, alternative design is to use a membrane tube 80 with a wire 82 inside the tube as the anode material. Optionally multiple membrane tubes 80 may be used. The membrane tube 80 may be in a coil or other shape. This approach avoids the need for the membrane plate 60 because there is no need to clamp a planar membrane. The chamber can then be more open to for electrical current flow. This approach also avoids the risk of flow leaking between adjacent channels. Rather, the flow is confined to within the membrane tube and is forced to follow the path of the tube. The design of FIG. 7 may also enable more efficient draining of the catholyte chamber because there is flat divider between the anolyte and catholyte. The tubes can reside within the catholyte and so catholyte can be drained from a low spot below the elevation of the membrane tubes.

For the case of a constant area channel, the spiral flow path created by the clamping the membrane to the divider walls 44 can be thought of as similar to the flow within a spiraled tube. For a constant area channel, the flow velocity in the channel and over the anode and the membrane is constant and high throughout its entire length. In contrast, with existing conventional processors, the anolyte flow might he high near the flow inlet, but the velocity dissipates as the flow is distributed over the volume of the anode compartments making it difficult to use the flow to help sweep away bubbles.

The coiled electrolyte path of FIGS. 1-6 may be used in various types of electroplating processors, other than the processor shown in FIGS. 1 and 2. Specifically, it may be used in any electroplating processor having a vessel and a membrane. Where the membrane tube of FIG. 7 is used, no other separate membrane is needed.

Figure 8:
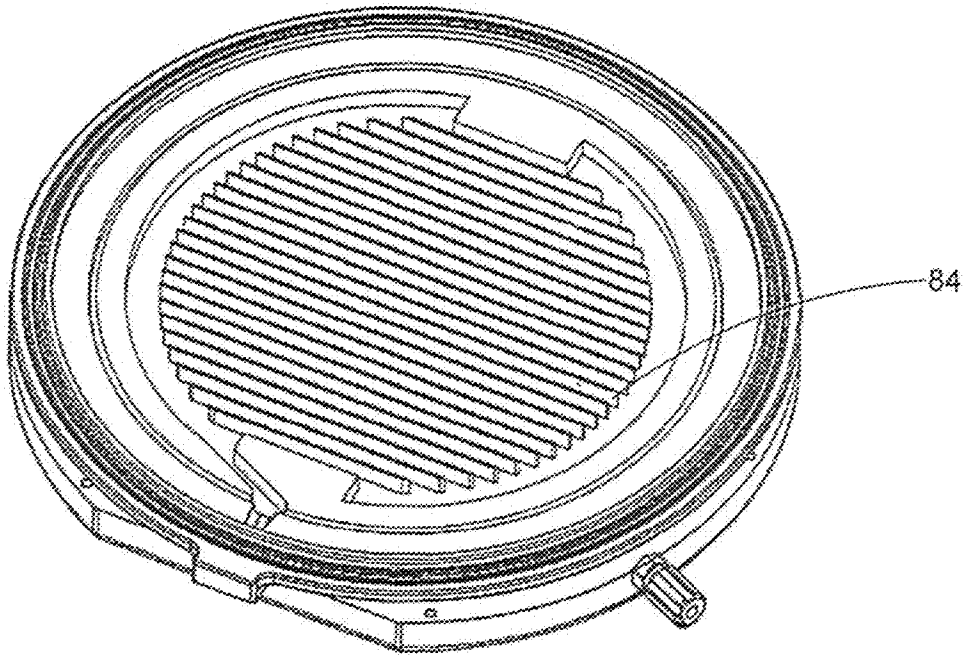
FIG. 8 is a top perspective view of an alternative design having an electrolyte flow channel formed as a linear array.

The electrolyte flow channel need not be a spiral, have concentric rings, or even include largely curved shapes. Rather, as shown in FIG. 8, the channel 42 may have an array or other arrangement of straight segments 84. As one example, the channel may be formed as a array of progressively larger quadrilateral or other geometric shapes, generally matching the shape of the substrate. If desired, curved transition sections may be used at the ends of the straight segments 84, to reduce pressure loss through the channel. Similar designs using straight segments may also be used with the membrane tube as described above.

A method for electroplating a workpiece may include pumping an electrolyte through a continuous flow path formed in a channel extending between an inlet and an outlet. The channel may be formed in an electrode plate, with a membrane on the electrode plate. If the membrane is used, then a membrane plate may be attached to the electrode plate, with the membrane in between the electrode plate and the membrane plate.

Thus, novel electroplating apparatus and methods have been shown and described. Various changes and substitutions may of course be made without departing from the spirit and scope of the invention. The invention, therefore, should not be limited except by the following claims and their equivalents.

The invention claimed is:

1. An electroplating processor, comprising:

a vessel;

an electrode plate in the vessel with a continuous flow path formed in a channel in the electrode plate and extending between an inlet and an outlet on the electrode plate, the continuous flow path having rings formed into a coil;

a membrane on top of the electrode plate, with the membrane covering the continuous flow path formed in the channel; and a membrane plate attached to the electrode plate, with the membrane in between the electrode plate and the membrane plate.

2. The electroplating processor of claim 1 with the membrane plate having a coiled support matching the shape of the channel wall.

3. The electroplating processor of claim 2 with the channel wall having a flat top surface and the coiled support having a flat bottom surface, and with the membrane clamped between the flat top surface of the channel wall and the flat bottom surface of the coiled support.

4. The electroplating processor of claim 1 further comprising a flat inert electrode at the bottom of the channel.

5. The electroplating processor of claim 4 with the channel and the flat electrode having a rectangular cross section.

6. The electroplating processor of claim 1 wherein the continuous flow path is a spiral or concentric circles connected by flow segments.

7. The electroplating processor of claim 1 wherein the cross section of the flow path adjacent to the outlet is greater than at the inlet.

8. The electroplating processor of claim 2 wherein the membrane plate has one or more rings of ribs, and with the coiled support attached to a bottom surface of the ribs.

9. The electroplating processor of claim 1 with the electrode plate having a thickness equal to 2-5 of the depth of the channel.

10. An electroplating processor, comprising:

a vessel;

an electrode plate at a bottom of the vessel;

a coiled channel on a top surface of the electrode plate, with the coiled channel forming a coiled flow path between a coiled channel wall;

an electrolyte inlet and an electrolyte outlet in the electrode plate, with the coiled flow path connecting the electrolyte inlet to the electrolyte outlet;

at least one electrode in the coiled channel;

a membrane plate attached to the electrode plate;

a coiled support on a bottom surface of the membrane plate in alignment with the channel wall; and a membrane in between the electrode plate and the membrane plate, and the membrane compressed between a top surface of the channel wall and a bottom surface of the coiled support.

11. The electroplating processor of claim 10 with the flow path having 5 to 10 rings formed between the channel wall.

12. The electroplating processor of claim 10 with the channel wall having a flat top surface and the coiled support having a flat bottom surface.

13. The electroplating processor of claim 10 comprising first and second electrodes in the channel.

14. The electroplating processor of claim 13 with the first and second electrodes comprising inert electrodes.

15. An electroplating processor, comprising:

a vessel;

an electrode plate in the vessel with a continuous flow path formed in a channel in the electrode plate and extending between an inlet and an outlet on the electrode plate, the continuous flow path having rings formed between a coiled channel wall;

a membrane on the electrode plate;

a membrane plate attached to the electrode plate, with the membrane in between the electrode plate and the membrane plate, and with the membrane plate having a coiled support matching the shape of the channel wall.

* * * * *